United States Patent [19]

Spears

[11] 3,970,220

[45] July 20, 1976

[54] COLLAPSIBLE TUBE SQUEEZING DEVICE

[76] Inventor: Cecil Julius Spears, 112 McFarland Road, Enfield, N.C. 27823

[22] Filed: Aug. 26, 1974

[21] Appl. No.: 500,444

[52] U.S. Cl. ..... 222/102
[51] Int. Cl.[2] ..... B65D 35/28
[58] Field of Search ..... 222/93, 102, 103, 97

[56] References Cited

UNITED STATES PATENTS

| | | | |
|---|---|---|---|
| 1,617,917 | 2/1927 | Lawton | 222/103 |
| 2,179,012 | 11/1939 | Kach | 222/93 |
| 2,179,012 | 11/1939 | Kach | 222/102 X |
| 2,612,290 | 9/1952 | Lipton | 222/93 |
| 2,708,532 | 5/1955 | Tarbox | 222/100 |
| 3,281,016 | 10/1966 | Thompson | 222/103 |

FOREIGN PATENTS OR APPLICATIONS

| | | | |
|---|---|---|---|
| 1,272,937 | 6/1961 | France | 222/102 |

*Primary Examiner*—Stanley H. Tollberg
*Assistant Examiner*—Norman L. Stack, Jr.
*Attorney, Agent, or Firm*—Harold L. Stowell

[57] ABSTRACT

A collapsible tube squeezer comprises a frame having open ends and a pair of squeeze rolls mounted for rotation in the sidewalls of the frame and tube crown squeezing and holding means carried by the said frame in substantial alignment with the tube receiving space between the pair of squeeze rolls.

4 Claims, 6 Drawing Figures

COLLAPSIBLE TUBE SQUEEZING DEVICE

BACKGROUND OF THE INVENTION

Collapsible tube squeezing devices for dispensing the contents of tubes containing toothpaste, hair creme, hand lotion, shoe polishing creme, glue, and the like are well known in the art. A review of the prior art devices shows that while such devices exist they have not received substantial user acceptance due to their expense, size, lack of universality, difficulties with operation and the necessity to use both of the operator's hands in emptying the contents of collapsible tubes.

The advent of collapsible tubes formed of plastic, rather than the well known metallic type collapsible tubes, has also presented additional problems which have rendered many pre-plastic tube squeezing devices unsuitable for their intended purposes particularly in regard to removal of the contents of the crown portion of such tubes. Crown portions of plastic collapsible tubes have a tendency to be substantially more rigid than metallic tubes which factor coupled with the resiliency of plastics often employed in the manufacture of plastic collapsible tubes necessitates that special measures be undertaken in order to completely empty such tubes.

THE PRESENT INVENTION

It is a particular object of the present invention to provide a collapsible tube squeezing device which will accommodate a large variety of sizes of collapsible tubes in a relatively inexpensive, simple to operate, collapsible tube squeezing device which is particularly adapted to remove the contents of both metallic and plastic forms of tubes.

It is a further object to provide such a device having means for squeezing the tube crown and holding the crown in a dispensing position to thereby permit removal of substantially the entire contents of collapsible tubes.

Another object of the present invention is to provide such a device which is relatively compact in size and may be operated with one hand and with the base of the device aligned in substantially any plane, that is, the provision of a tube squeezing device which is not direction sensitive.

It is a further objection of the present invention to provide such a device which may be cast, molded, stamped or formed from plastic, metal or combinations thereof or any suitable material.

In general the present invention comprises a collapsible tube squeezing device comprising a frame having open ends, a bottom wall and a pair of sidewalls; first and second squeeze rollers mounted for rotation in the sidewalls of the frame; one of said first and second squeeze rollers having roller rotating means connected thereto and extending normally from one of the sidewalls of the frame; and tube crown squeezing and holding means carried by said sidewalls of the frame in substantial alignment with the tube receiving space between the air of squeeze rollers.

BRIEF DESCRIPTION OF THE DRAWINGS

The invention will be more particularly described in reference to the accompanying drawing wherein.

SPECIFIC DESCRIPTION OF THE INVENTION

Figure 3:
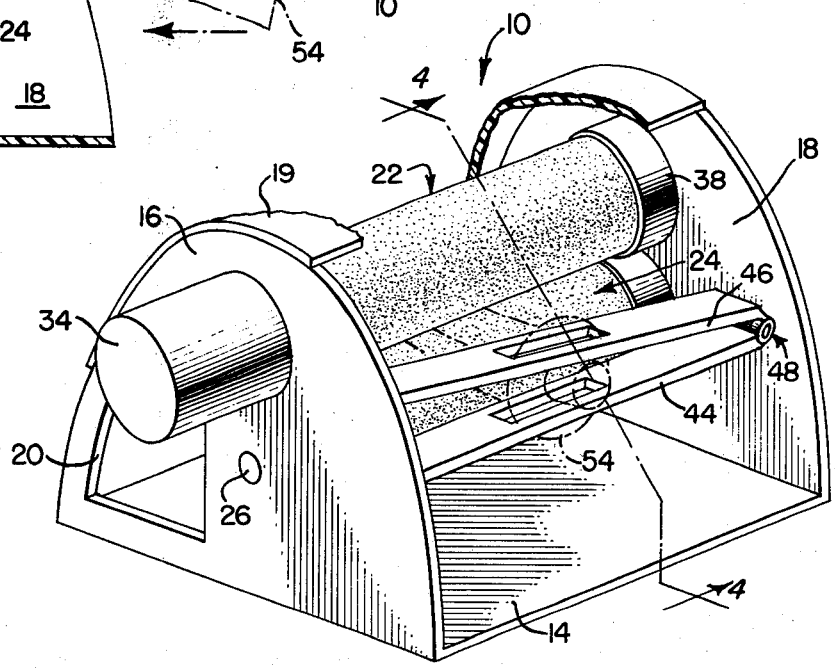
FIG. 3 is a view of the device shown in FIGS. 1 and 2 with a collapsible tube positioned in the device and the crown squeezing and holding means in an operative position.
Figure 4:
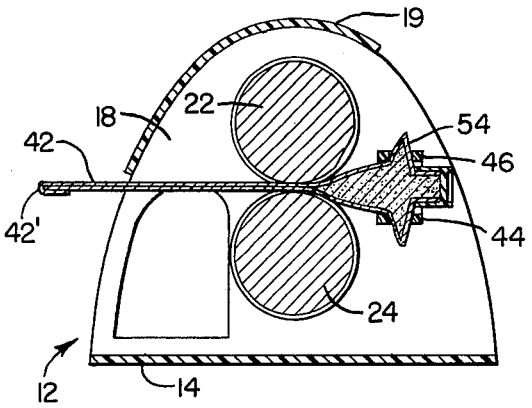
FIG. 4 is a view on line 4—4 of FIG. 3.

The improved collapsible tube squeezing device is generally designated 10 and includes a frame or housing 12 having a bottom wall 14 and sidewalls 16 and 18. The frame 12 may be conveniently cast from a die-casting metal or injection molded from a high impact plastic, such as one of the polystyrenes or the device could be made from sheet metal by conventional stamping and bending equipment. In the illustrated form of the invention, the sidewalls 16 and 18 are semi-oval in form and inletted as at 22 to reduce the size of the device and to reduce the amount of material necessary to construct the frame. The assembly may also include a partial cover 19, as more clearly shown in FIGS. 3 and 4.

Between the pair of sidewalls 16 and 18 are rotatably mounted a pair of squeeze rolls or rollers generally designated 22 for the top roll and 24 for the bottom roll. The rollers have a length substantially equivalent to the spacing between the inner faces of sidewalls 16 and 18, and the bottom roll is provided with an integral shaft which projects from each end as more clearly shown in FIG. 6 and designated 26. The projecting shaft ends pass through bores in each of the sidewalls 16 and 18.

The upper roll 22 has a short shaft 28 which passes through a bore in sidewall 18 while the opposite end 30 of the roll is provided with a square or the like non-cylindrical opening 32 which receives a complimentary shaft 32' projecting from the inner face of operating handle or roll 34 and is maintained in the opening 32 by press fitting, cementing or the like.

Figure 1:
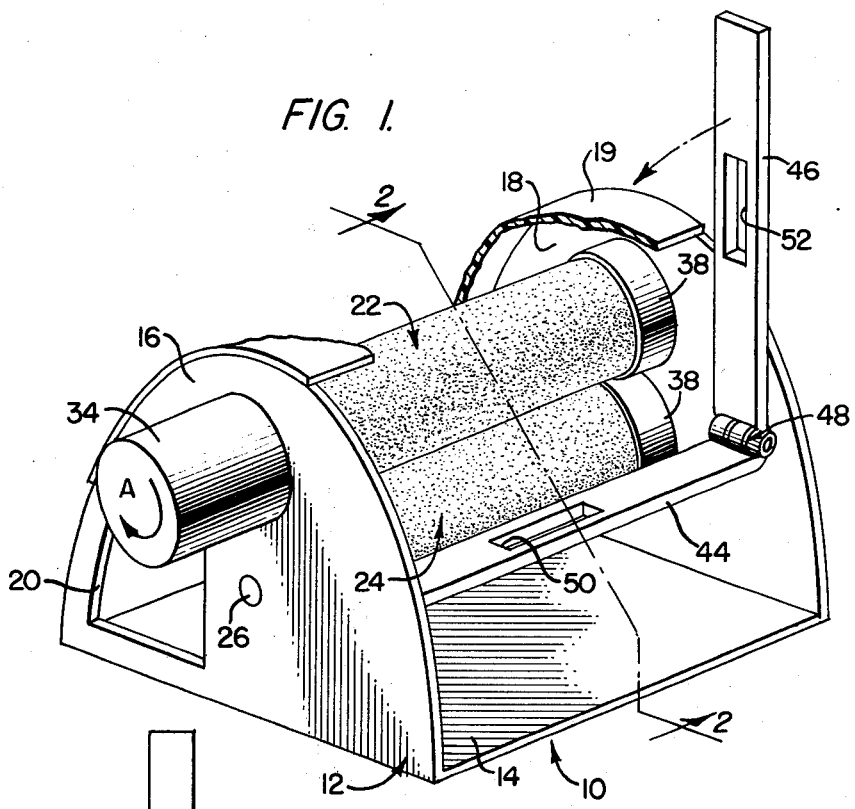
FIG. 1 is a perspective view of one form of collapsible tube squeezing device of the present invention.
Figure 2:
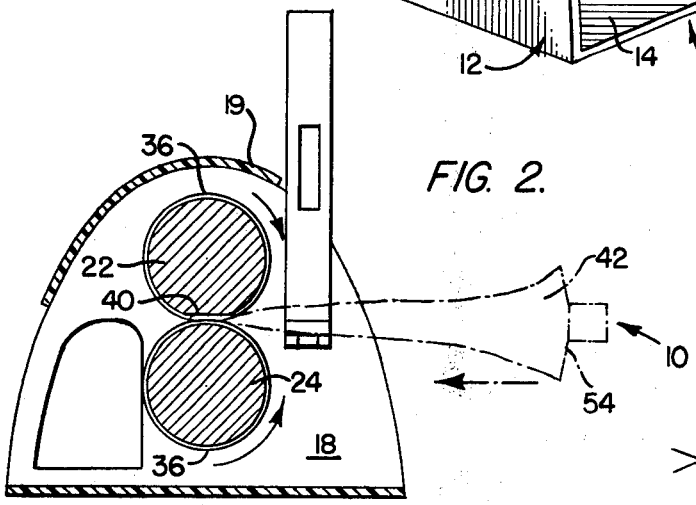
FIG. 2 is a section on line 2 of FIG. 1.

The external surface of each of the rolls 22 and 24 is covered with a roughened gripping surface 36 which may be molded thereon or attached thereto which gripping surface, when attached thereto, may comprise conventional sandpaper as more clearly shown in FIG. 2 of the drawing. The sandpaper 36 extends substantially the length of each of the rolls but for the end portions which comprise bands of friction material such as rubber bands 38.

The gripping surface may be provided by molding or forming the upper roller or both the upper and lower rollers with a plurality of flutes or the cylindrical surface may be in the form of a multi-sided prism in cross section.

The rubber bands 38, when in place, provide enlarged diameter ends for the roll and the bores for the shafts of the rolls are spaced such that the opposed bands are in intimate frictional contact whereby upon turning the handle 34 in the direction of the directional arrow A the frictional contact between the bands 38 drives the lower roll 24 thereby eliminating the need for intermeshing gears, etc. which eliminated elements substantially increase the complexity and cost of prior devices.

It will also be particularly noticed from FIG. 2 of the drawing that the upper roll 22 is provided with a flattened surface 40 which extends the length of the roll. This flattened surface is dimensioned such that when the flattened surface 40 is directly opposite its complimentary roll 24, as shown in FIG. 2, the user of the device may freely insert the butt end of the collapsible tube 42 within the provided space to ensure relatively easy starting of the squeezing action of the pair of rolls.

The assembly, as hereinbefore set forth, also includes a crown crushing and holding device which, as will be more fully described hereinafter, comes into play as the tube approaches its empty condition. The crown squeezing and holding mechanism includes a base member 44 which is supported between the inner surfaces of the sidewalls 16 and 18 in substantial alignment with the opening between the pair of rolls 22 and 24. The other element of the crown squeezing device includes a cooperating bar 46 which is hinged as at 48 to the sidewall 18 or to the lower platform 44. Each of the elements 44 and 46 is provided with a rectangular opening, 50 in the base member 44 and 52 in the hinged bar 46. The openings as more clearly shown in FIGS. 3 and 4 of the drawing seat and anchor the crown portion 54 of the tube 42 therebetween so that downward force on the hinge bar 46 collapses the crown and the tube material rearward thereof to express substantially all of the contents from that area of the collapsible tube.

Figure 5:
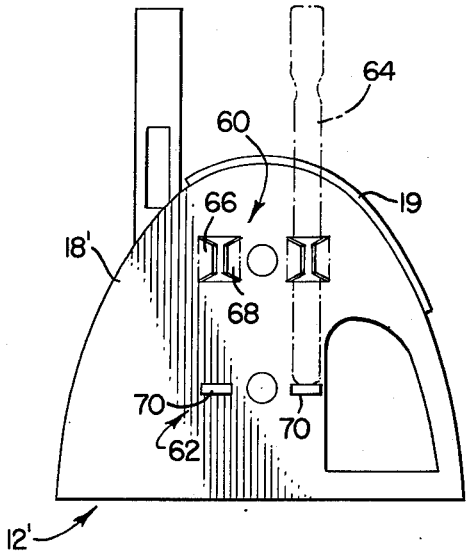
FIG. 5 is a side elevational view of a modified form of the present invention.
Figure 6:
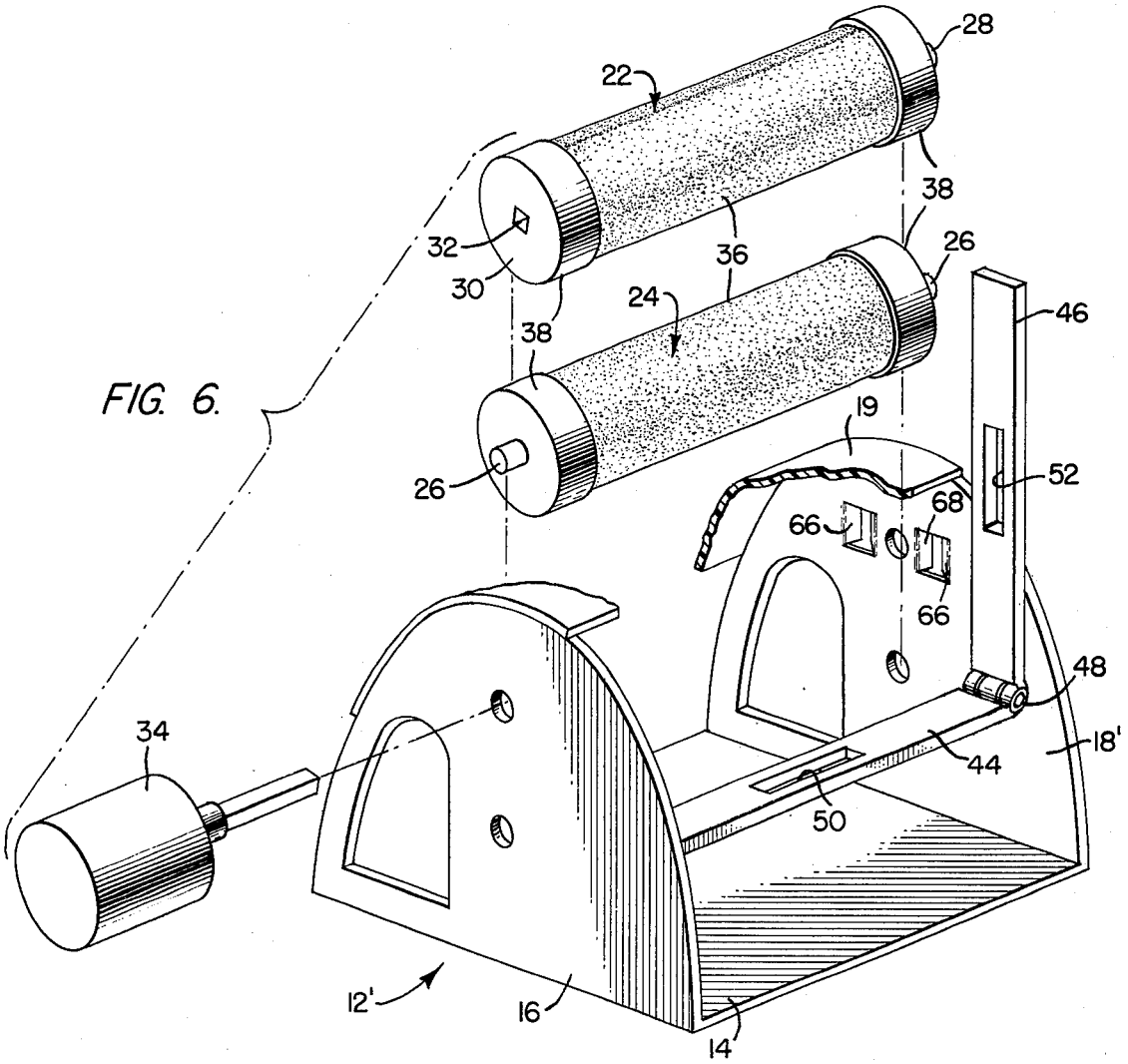
FIG. 6 is an exploded perspective view of the device shown in FIG. 5.

Referring now to FIGS. 5 and 6, a modified form of the present invention is illustrated wherein like parts are given identical reference characters to those used in describing FIGS. 1 through 4 and similar parts have been given prime reference characters. In the form of the invention shown in FIGS. 5 and 6, the device is identical to that previously described but for the form of the frame or housing 12' and more specifically only the sidewall 18' is modified to include means generally designated 60 and 62 for holding one or more toothbrushes shown in phantom lines at 64 on said sidewall 18'. Such means includes a pair of outturned ears 66 and 68 and a projecting platform 70. The pair of outturned ears 66 and 68 retain the shank or handle portion of a toothbrush 64 against the external face of the sidewall 18' and the platform 70 provides a seat or rest for the most extended portion of the toothbrush handle.

In a preferred embodiment of the present invention, each of the rolls 22 and 24 has a length of about 3 inches and a diameter of about 1 inch and the width of the resilient bands 38 is from about ¼ to ⅜ of an inch which provides sufficient frictional contact between the rolls to properly drive a collapsible tube therethrough. With rolls of the size disclosed herein, the sidewalls of the housing have a height of about 3 inches and a length at the base of 3 to 3½ inches.

In operation of the device, the upper roll 22 is aligned with the bottom roll by turning the handle 34 such that the flattened face of surface 40 is directly opposite the curvilinear surface of its lower roll. The pivotal crushing bar 46 is raised and butt 42' of the tube is inserted in the gap. The cap of the tube is removed and upon rotation of the handle or knob 34 the tube is drawn through the rollers as shown, for example, in FIGS. 2 and 4 expressing the contents therefrom. When the tube is substantially in the position shown in FIG. 4 the contents of the crown portion 54 may be expressed by lowering the crusher bar 46 and exerting pressure thereon.

From the foregoing description of a preferred and modified form of the present invention, it will be seen that the objects and advantages hereinbefore set forth and others are full accomplished.

I claim:

1. A collapsible tube squeezing device comprising a frame having open sides, a bottom wall and a pair of sidewalls;

first and second squeeze roller mounted for rotation in the sidewalls of the frame, one of said first and second squeeze rollers having roller rotating means connected thereto and extending normally from one of the sidewalls of the frame, and tube crown squeezing and holding means carried by said sidewalls of the frame in substantial alignment with the tube receiving space between the pair of squeeze rollers wherein said tube crown squeezing and holding means comprises a base member rigidly connected between the pair of sidewalls and a crusher bar pivotally mounted adjacent one end to one end of the base member.

2. A collapsible tube squeezing device as defined in claim 1 wherein the external surfaces of the first and second squeeze rollers have roughened surfaces and the extended ends of said first and second squeeze rollers are provided with frictional surfaces whereby said one of said rollers drives the other of said rollers by frictional engagement.

3. The invention defined in claim 1 wherein said base member and the crushing bar are each provided with rectangular openings adapted to engage portions of the crown of a tube to be squeezed.

4. A collapsible tube squeezing device as defined in claim 3 including means for supporting at least one toothbrush to the external surface of one of the pair of sidewalls.

* * * * *